US010161167B2

(12) United States Patent
Alexander et al.

(10) Patent No.: US 10,161,167 B2
(45) Date of Patent: Dec. 25, 2018

(54) LOCKABLE LATCHING DEVICE

(71) Applicants: GM GLOBAL TECHNOLOGY OPERATIONS LLC, Detroit, MI (US); Dynalloy, Inc., Tustin, CA (US)

(72) Inventors: Paul W. Alexander, Ypsilanti, MI (US); Roger Herbert Culver, Warren, MI (US); Robert Dallos, Jr., Canton, MI (US); Aragorn Zolno, Whittier, CA (US); James Holbrook Brown, Temecula, CA (US)

(73) Assignees: GM Global Technlolgy Operations LLC, Detroit, MI (US); Dynalloy, Inc., Tustin, CA (US)

( * ) Notice: Subject to any disclaimer, the term of this patent is extended or adjusted under 35 U.S.C. 154(b) by 925 days.

(21) Appl. No.: 14/686,070

(22) Filed: Apr. 14, 2015

(65) Prior Publication Data

US 2015/0300055 A1 Oct. 22, 2015

Related U.S. Application Data

(60) Provisional application No. 61/980,311, filed on Apr. 16, 2014.

(51) Int. Cl.

| | |
|---|---|
| ***E05C 3/06*** | (2006.01) |
| ***E05B 83/28*** | (2014.01) |
| ***E05C 19/02*** | (2006.01) |
| *E05C 5/00* | (2006.01) |
| *E05C 1/12* | (2006.01) |

(52) U.S. Cl.
CPC ..... *E05B 83/28* (2013.01); *E05C 19/022* (2013.01)

(58) Field of Classification Search
CPC ..... E05B 83/28; E05C 19/022
USPC ..... 292/63, 169, 65, 170, DIG. 37, 200
See application file for complete search history.

(56) References Cited

U.S. PATENT DOCUMENTS

| | | | | |
|---|---|---|---|---|
| 2,497,425 A * | 2/1950 | Terry | F23L 13/02 | 126/285 R |
| 3,178,213 A * | 4/1965 | Nelson | E05C 19/02 | 292/18 |
| 3,832,243 A * | 8/1974 | Donkersloot et al. | C22C 1/02 | 148/402 |

(Continued)

FOREIGN PATENT DOCUMENTS

| | | |
|---|---|---|
| CN | 101151460 A | 3/2008 |
| CN | 102656044 A | 9/2012 |

(Continued)

*Primary Examiner* — Kristina R Fulton
*Assistant Examiner* — Faria F Ahmad
(74) *Attorney, Agent, or Firm* — Quinn IP Law

(57) ABSTRACT

A lockable latching device includes a body defining a cavity and having a central longitudinal axis, and a plunger disposed within the cavity. The plunger has a first end and a second end and is translatable along the axis between an open position and a closed position. The device includes an annular rotator disposed along the axis and configured for rotating the plunger about the axis. The device also includes an annular latch abutting the rotator that is transitionable between an unlocked state and a locked state. The device includes a first element operably connected to the latch and formed from a first shape memory alloy and a second element operably connected to the latch and formed from a second shape memory alloy.

15 Claims, 4 Drawing Sheets

(56) References Cited

U.S. PATENT DOCUMENTS

| | | | | | |
|---|---|---|---|---|---|
| 4,207,655 | A * | 6/1980 | MacMaster | F16B 5/10 | 292/62 |
| 4,227,726 | A * | 10/1980 | Sorimachi | E05C 19/165 | 292/251.5 |
| 2003/0222464 | A1* | 12/2003 | Don | E05B 55/005 | 292/347 |
| 2004/0075281 | A1* | 4/2004 | Ueki | E05C 19/022 | 292/65 |
| 2006/0006663 | A1* | 1/2006 | Harada | E05C 5/00 | 292/63 |
| 2007/0216169 | A1* | 9/2007 | Jackson, Jr. | E05B 1/0038 | 292/169 |
| 2009/0079205 | A1* | 3/2009 | Nishida | B60N 3/083 | 292/166 |
| 2012/0013134 | A1* | 1/2012 | Loret de Mola | E05B 5/00 | 292/164 |
| 2015/0300058 | A1* | 10/2015 | Alexander | E05B 47/0009 | 292/63 |

FOREIGN PATENT DOCUMENTS

| | | | |
|---|---|---|---|
| CN | 103423115 | A | 12/2013 |
| EP | 2182148 | A2 | 5/2010 |

* cited by examiner

LOCKABLE LATCHING DEVICE

CROSS-REFERENCE TO RELATED APPLICATIONS

This application claims the benefit of U.S. Provisional Application No. 61/980,311, filed on Apr. 16, 2014, which is hereby incorporated by reference in its entirety.

TECHNICAL FIELD

The disclosure relates to a lockable latching device.

BACKGROUND

Storage and transportation devices often include a closure configured for storing goods. For example, vehicles often include closures such as a glove box, a storage console, a fuel filler compartment, and the like. Such closures generally include a latch mechanism configured for latching and unlatching the closure. The latch mechanism may include numerous mechanical components, such as levers and latch arms, which are engaged to hold the closure in a closed position.

SUMMARY

A lockable latching device includes a body defining a cavity therein and having a central longitudinal axis. The lockable latching device also includes a plunger disposed within the cavity and having a first end and a second end spaced apart from the first end. The plunger is translatable with respect to the body along the central longitudinal axis between an open position in which the second end is disposed within the cavity, and a closed position in which the second end protrudes from the cavity. The lockable latching device also includes an annular rotator disposed along the central longitudinal axis and configured for rotating the plunger about the central longitudinal axis. In addition, the lockable latching device includes an annular latch abutting the annular rotator. The annular latch is transitionable between an unlocked state in which the annular latch is positioned about the central longitudinal axis such that the plunger is transitionable between the open position and the closed position and a locked state in which the annular latch is positioned about the central longitudinal axis such that the plunger is not transitionable between the open position and the closed position. The lockable latching device further includes a first element operably connected to the annular latch and formed from a first shape memory alloy that is transitionable between a first austenite crystallographic phase and a first martensite crystallographic phase in response to a first activation signal to thereby transition the annular latch from the unlocked state to the locked state. The lockable latching device also includes a second element operably connected to the annular latch and formed from a second shape memory alloy that is transitionable between a second austenite crystallographic phase and a second martensite crystallographic phase in response to a second activation signal to thereby transition the annular latch from the locked state to the unlocked state.

In another embodiment, the plunger includes a plurality of legs extending from the second end and spaced apart from one another about the central longitudinal axis. Each of the plurality of legs includes a first edge that is substantially parallel to the central longitudinal axis, a second edge intersecting the first edge at a vertex that is spaced apart from the second end, and a third edge connecting the first edge and the second edge. The first edge and the second edge define an acute angle therebetween. Further, the annular latch includes a plurality of sloped protrusions each spaced apart from one another about the central longitudinal axis.

In a further embodiment, the lockable latching device also includes an actuator housing having a first portion attachable to the body and defining a first bore therein, and a second portion substantially perpendicular to the first portion and defining a second bore therein. The first bore and the second bore are connected to define an L-shaped channel.

As used herein, the terms "a," "an," "the," "at least one," and "one or more" are interchangeable and indicate that at least one of an item is present. A plurality of such items may be present unless the context clearly indicates otherwise. All numerical values of parameters, quantities, or conditions in this disclosure, including the appended claims, are to be understood as being modified in all instances by the term "about" or "approximately" whether or not "about" or "approximately" actually appears before the numerical value. "About" and "approximately" indicate that the stated numerical value allows some slight imprecision (e.g., with some approach to exactness in the value; reasonably close to the value; nearly; essentially). If the imprecision provided by "about" or "approximately" is not otherwise understood with this meaning, then "about" and "approximately" as used herein indicate at least variations that may arise from methods of measuring and using such parameters. Further, the terminology "substantially" also refers to a slight imprecision of a condition (e.g., with some approach to exactness of the condition; approximately or reasonably close to the condition; nearly; essentially). In addition, disclosed numerical ranges include disclosure of all values and further divided ranges within the entire range. Each value within a range and the endpoints of a range are all disclosed as separate embodiments. The terms "comprising," "includes," "including," "has," and "having" are inclusive and therefore specify the presence of stated items, but do not preclude the presence of other items. As used in this disclosure, the term "or" includes any and all combinations of one or more of the listed items.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
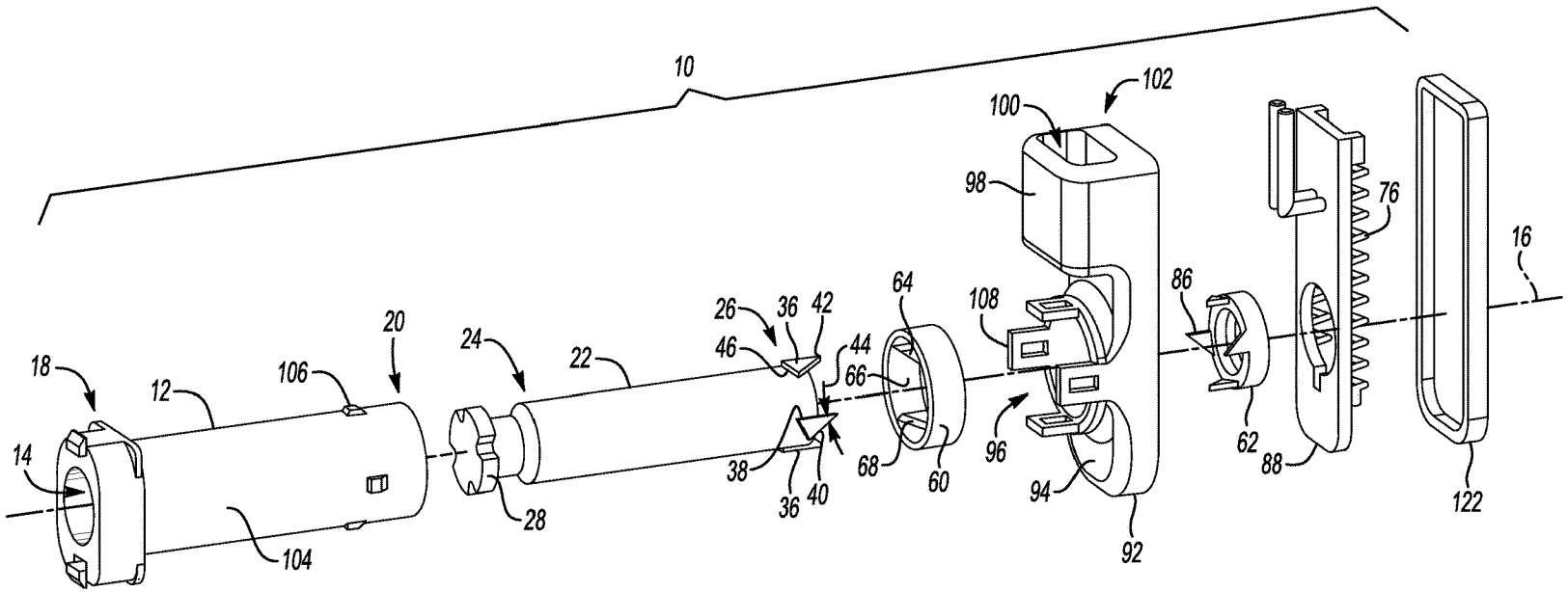
FIG. 1 is a schematic illustration of an exploded view of a lockable latching device.

Referring to the Figures, wherein like reference numerals refer to like elements, a lockable latching device is shown at 10 in FIG. 1. The lockable latching device 10 is both latchable, i.e., closeable or fastenable, and lockable. That is, the lockable latching device 10 may open, close, lock, and unlock. Therefore, the lockable latching device 10 may be useful for closures (not shown) for storage and transportation applications. For example, the lockable latching device 10 may be useful for vehicle applications such as fuel filler doors, glove boxes, storage bins, consoles, and the like. However, the lockable latching device 10 may also be useful for non-vehicular storage applications such as cabinetry, lockers, safes, and the like.

Referring to FIG. 1, the lockable latching device 10 includes a body 12 defining a cavity 14 therein and having a central longitudinal axis 16. The body 12 may have a generally cylindrical shape and may protect other components of the lockable latching device 10 from contaminants during operation. The body 12 may have a proximal end 18 and a distal end 20 spaced apart from the proximal end 18 along the central longitudinal axis 16, and may be formed from a material such as metal or plastic according to the operating conditions of the lockable latching device 10.

The lockable latching device 10 also includes a plunger 22 disposed within the cavity 14 and having a first end 24 and a second end 26 spaced apart from the first end 24. The plunger 22 may also have a generally cylindrical shape and may slide within the cavity 14 along the central longitudinal axis 16. The first end 24 may be configured for engaging a door (not shown) of a closure (not shown), such as, for example, a fuel filler door of a vehicle. The first end 24 may define a plurality of members 28 configured for mating with a corresponding one of a plurality of grooves (not shown) defined by the door. That is, the first end 24 may be keyed to the plurality of grooves. For example, as shown in FIG. 1, the plurality of members 28 may form a cross and may each align with and seat within a respective one of the plurality of grooves when an operator shuts or closes the door. Alternatively, the plurality of members 28 may form a star, circle, square, or other pattern or shape or arrangement to thereby align with or rest within the plurality of grooves during certain operating conditions. That is, as set forth in more detail below, the plunger 22 may rotate about the central longitudinal axis 16 during operation of the lockable latching device 10 so as to alternately align and unalign the plurality of members 22 with the plurality of grooves defined by the door and thereby join to the door to open or close the door. Conversely, the plurality of members 28 may not align with or seat within the respective one of the plurality of grooves when the plunger 22 rotates about the central longitudinal axis 16, e.g., when the door is opened. Further, although not shown, the lockable latching device 10 may also include a resilient member, such as a compression spring, that is configured for applying a constant force to the plunger 22 in an upward direction (denoted by arrow 30 in FIG. 5) along the central longitudinal axis 16.

Figure 2:
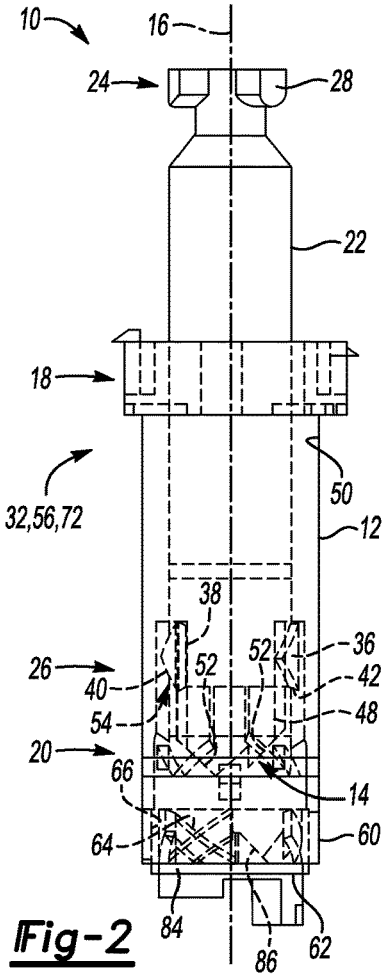
FIG. 2 is a schematic illustration of a side view of a body, a plunger, an annular rotator, and an annular latch of the lockable latching device of FIG. 1, wherein the plunger is disposed in an open position and an unlatched position.
Figure 3:
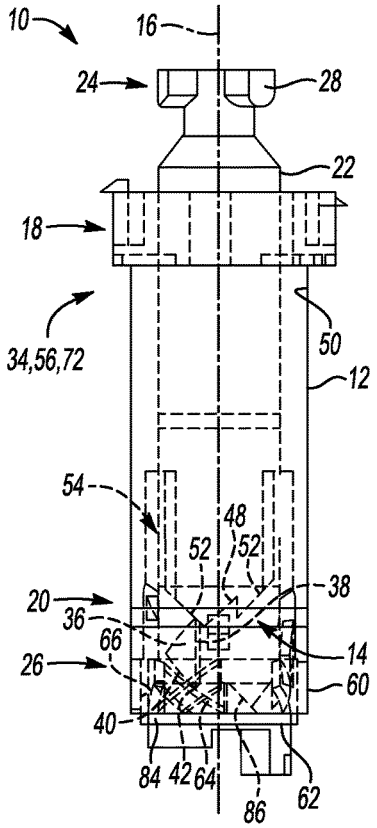
FIG. 3 is a schematic illustration of a side view of the lockable latching device of FIG. 2, wherein the plunger is depressed towards the annular rotator and the annular latch.
Figure 4:
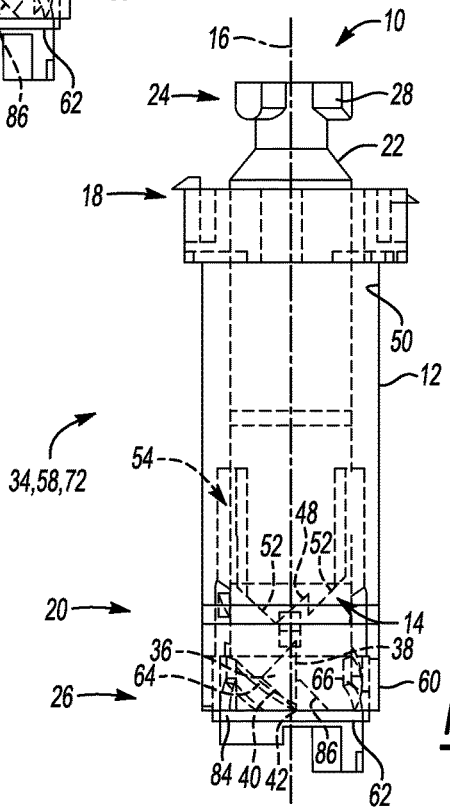
FIG. 4 is a schematic illustration of a side view of the lockable latching device of FIG. 1, wherein the plunger is disposed in a closed position.

Referring now to FIGS. 2-4, the plunger 22 is translatable within the cavity 14. That is, the plunger 22 is translatable with respect to the body 12 along the central longitudinal axis 16 between an open position 32 (FIG. 2) in which the second end 26 is disposed within the cavity 14, and a closed position 34 (FIG. 4) in which the second end 26 protrudes from the cavity 14. For example, an operator may depress the plunger 22, e.g., by pressing against a door (not shown) or surface (not shown) mated to the first end 24 of the plunger 22, to thereby transition the plunger from the open position 32 to the closed position 34. Therefore, the plunger 22 may be disposed in the open position 32 when the door or surface of the closure (not shown) is also open or spaced apart from a complementary component (not shown) to which the door or surface latches and/or locks. Conversely, the plunger 22 may be disposed in the closed position 34 when the door or surface of the closure is also closed, e.g., latched and/or locked to, the complementary component. That is, when the plunger 22 is disposed in the open position 32, an operator may access a storage compartment (not shown) covered by the door or surface. However, when the plunger 22 is disposed in the closed position 34, the door or surface may seal off and cover the storage compartment.

Referring again to FIG. 1, the plunger 22 includes a plurality of legs 36 extending from the second end 26 and each spaced apart from one another about the central longitudinal axis 16. For example, the plunger 22 may include four legs 36. The plurality of legs 36 may interact with the body 12 as the plunger 22 is depressed and translates between the open position 32 (FIG. 2) and the closed position 34 (FIG. 4), as set forth in more detail below.

As best shown in FIGS. 3-6, each of the plurality of legs 36 may be generally triangular-shaped. More specifically, each of the plurality of legs 36 may include a first edge 38 that is substantially parallel to the central longitudinal axis 16, and a second edge 40 intersecting the first edge 38 at a vertex 42 that is spaced apart from the second end 26. The first edge 38 and the second edge 40 may define an acute angle 44 (FIG. 1) therebetween. That is, the second edge 40 may slope away from the first edge 38 at less than 90°. Further, each of the plurality of legs 36 may include a third edge 46 connecting the first edge 38 and the second edge 40.

Figure 5:
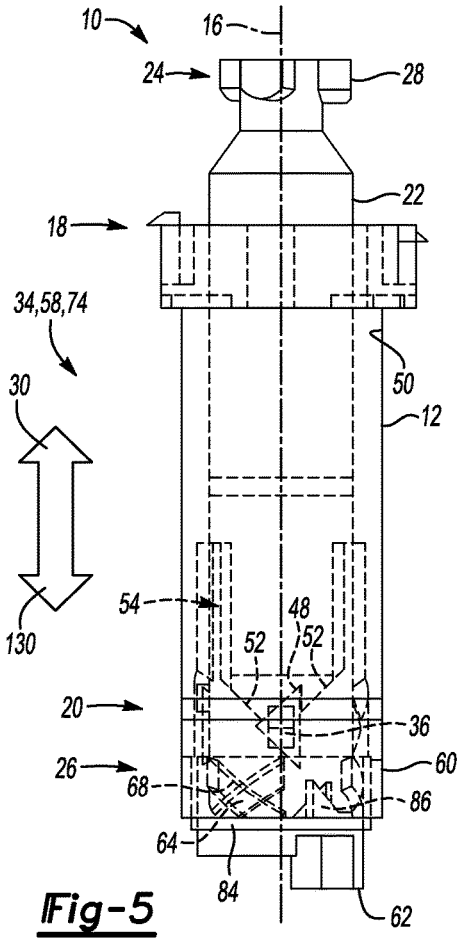
FIG. 5 is a schematic illustration of a side view of the lockable latching device of FIG. 4, wherein the plunger is disposed in a closed position and a latched position.

Referring now to FIGS. 3 and 4, the body 12 may have an internal surface 50 facing the plunger 22 and may include a plurality of ribs 52 extending along the internal surface 50. Adjacent ones of the plurality of ribs 52 may define a retention notch 48 therebetween. Further, one of the plurality of legs 36 may be matable with the retention notch 48 as the plunger 22 translates from the open position 32 (FIG. 2) to the closed position 34 (FIG. 4). For example, as best shown in FIG. 5, each of the plurality of legs 36 is abuttable with a respective one of the plurality of retention notches 48 when the plunger 22 is disposed in the closed position 34. That is, each leg 36 may contact the respective retention notch 48 so that the plunger 22 may no longer translate along the central longitudinal axis 16 in an upward direction 30, i.e., toward the proximal end 18 of the body 12. Therefore, after an operator initially depresses the plunger 22, e.g., by pressing against the door (not shown) or surface mated to the first end 24 to shut the door against a complementary component (not shown) to thereby enclose and cover a storage compartment (not shown), the plunger 22 may remain depressed within the cavity 14 since each of the plurality of legs 36 may rest against a respective one of the plurality of retention notches 48.

As described with continued reference to FIGS. 3 and 4, the internal surface 50 may further define a plurality of release channels 54 therein, wherein adjacent ones of the plurality of release channels 54 are spaced apart from one another by the plurality of ribs 52. Each of the plurality of legs 36 may be translatable within a respective one of the plurality of release channels 54 when the plunger 22 is disposed in the open position 32 (FIG. 2). That is, as described with reference to FIG. 2 and set forth in more detail below, when the plunger 22 is disposed in the open position 32, each leg 36 may not contact the respective retention notch 48, but may instead be translatable within the respective release channel 54 so that the plunger 22 may travel along the central longitudinal axis 16 in an upward direction 30, i.e., toward the proximal end 18 of the body 12 or in a downward direction (denoted by arrow 130 in FIG. 5), i.e., toward the distal end 20 of the body 12. Therefore, when the plurality of legs 36 are disposed within a respective one of the plurality of release channels 54, after an operator again depresses the plunger 22, e.g., by again pressing against the door (not shown) or surface mated to the first end 24, the plunger 22 may pop up within the cavity 14 since each of the plurality of legs 36 may travel within a respective one of the plurality of release channels 54.

Referring now to FIGS. 2-6, during certain circumstances, the plunger 22 may also be rotatable about the central longitudinal axis 16 as the plunger 22 is depressed, i.e., as the plunger 22 translates along the central longitudinal axis 16 in the downward direction 130 (FIG. 5). In particular, the plunger 22 may be rotatable between an unlatched position 56 (FIGS. 2 and 3) in which one of the plurality of legs 36 is positioned about the central longitudinal axis 16 so that the one of the plurality of legs 36 is not abuttable with, i.e., not vertically aligned with, the retention notch 48 as the plunger 22 translates towards the distal end 20, and a latched position 58 (FIGS. 4-6) in which the one of the plurality of legs 36 is positioned about the central longitudinal axis 16 so that the one of the plurality of legs 36 is abuttable with, i.e., is aligned with, the retention notch 48 as the plunger 22 translates towards the proximal end 18. That is, a respective one of the plurality of legs 36 may abut the retention notch 48 when the plunger 22 is disposed in the latched position 58. In contrast, each of the plurality of legs 36 may be translatable within a respective one of the plurality of release channels 54 when the plunger 22 is disposed in the unlatched position 56. The unlatched position 56 of the plunger 22 may correspond to a condition in which the door (not shown) or surface of the closure (not shown) is open and not sealed against a complementary component (not shown) so that a storage compartment (not shown) is accessible. Conversely, the latched position 58 of the plunger 22 may correspond to an opposite condition in which the door or surface of the closure is closed and mated against the complementary component so that the storage compartment is covered and not accessible.

Therefore, the open position 32 and the closed position 34 of the plunger 22 denote a vertical or longitudinal position of the plunger 22 within the cavity 14 along the central longitudinal axis 16, and the unlatched position 56 and the latched position 58 of the plunger 22 denote a rotational position of the plunger 22 about the central longitudinal axis 16.

As such, referring to FIG. 2, during some operating conditions, it is to be appreciated that the plunger 22 may be disposed in both the open position 32, i.e., so that the second end 26 does not protrude from the cavity 14, and the unlatched position 56, i.e., in which each leg 36 is not aligned or abuttable with a respective one of the plurality of retention notches 48. This operating condition may correspond to a condition in which the door (not shown) or surface is open or pivoted away from the complementary component (not shown).

However, as shown in FIG. 3, after the plunger 22 is initially depressed, the plunger 22 may be disposed in both the closed position 34, i.e., wherein the second end 26 protrudes from the cavity 14, and the unlatched position 56, i.e., wherein the one of the plurality of legs 36 is not aligned or abuttable with a respective one of the plurality of retention notches 48. During such a condition, the plunger 22 may pop back up, i.e., travel in the upward direction 30 (FIG. 5) within the cavity 14 after the plunger 22 is initially depressed since the plurality of legs 36 may not abut a respective one of the plurality of retention notches 48.

Figure 6:
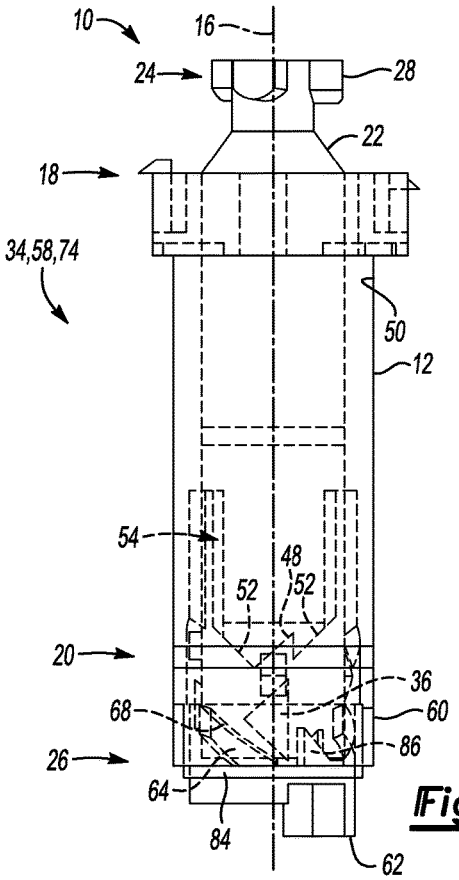
FIG. 6 is a schematic illustration of a side view of the lockable latching device of FIG. 5, wherein the annular latch has a locked state.

In contrast, during some operating conditions, as shown in FIGS. 4-6, the plunger 22 may be disposed in both the closed position 34, i.e., wherein the second end 26 protrudes from the cavity 14, and the latched position 58, i.e., wherein each leg 36 is abuttable with a respective one of the plurality of retention notches 48 so that the plunger 22 is retained along the central longitudinal axis 16. This operating condition may correspond to a condition in which the door (not shown) or surface is closed against or latched to the complementary component (not shown) to close off or cover the storage compartment (not shown).

Further, after the plunger 22 is again depressed for a second time, the plunger 22 may be disposed in both the closed position 34, i.e., wherein the second end 26 protrudes from the cavity 14, and the unlatched position 56, i.e., wherein the leg 36 is not aligned or abuttable with a respective one of the plurality of retention notches 48, so that each leg 36 may translate within a respective one of the plurality of release channels 54 as the plunger 22 travels in an upward direction 30 (FIG. 5) within the cavity 14. During such a condition, the plunger 22 may pop back up, i.e., travel in the upward direction 30 within the cavity 14 after the plunger 22 is again depressed since the plurality of legs 36 may not abut a respective one of the plurality of retention notches 48 and may therefore allow upwards translation of the plunger 22.

Referring again to FIG. 1, the lockable latching device 10 also includes an annular rotator 60 disposed along the central longitudinal axis 16 and configured for rotating the plunger 22 about the central longitudinal axis 16, as set forth in more detail below. In one non-limiting example, the annular rotator 60 may be spaced apart from the body 12 along the central longitudinal axis 16. The lockable latching device 10 further includes an annular latch 62 abutting the annular rotator 60 and configured for actuating release of the plunger 22 under certain operating conditions so that the plunger 22 may travel in the upward direction 30 (FIG. 5) within the cavity 14, as also set forth in more detail below. The annular rotator 60 may be disposed between the body 12 and the annular latch 62 about the central longitudinal axis 16.

As described with reference to FIGS. 2-4, the annular rotator 60 may include a plurality of ramps 64 each configured for guiding the vertex 42 of a respective one of the plurality of legs 36 towards the annular latch 62 as the plunger 22 rotates between the unlatched position 56 (FIGS. 2 and 3) and the latched position 58 (FIG. 4). That is, the annular rotator 60 may have an inside surface 66 that faces the plunger 22 and the inside surface 66 may define the plurality of ramps 64. The annular rotator 60 may include a number of ramps 64 corresponding to the number of legs 36 of the plunger 22, e.g., four. The plurality of ramps 64 may each have a sloped guide surface 68 and may be arranged radially about the central longitudinal axis 16 along the inside surface 66 of the annular rotator 60.

During operation, as described with reference to FIGS. 2-4, as the plunger 22 is first depressed or pushed in the downward direction 130 (FIG. 5) toward the distal end 20 of the body 12 along the central longitudinal axis 16, the plunger 22 translates within the cavity 14 towards the annular rotator 60. As shown in FIG. 3, as each leg 36 contacts a respective one of the plurality of ramps 64, each vertex 42 translates along the respective one of the plurality of ramps 64 to rotate the plunger 22 in a first direction 70 (FIG. 7) and translate the plunger 22 from the unlatched position 56 (FIGS. 2 and 3) to the latched position 58 (FIG. 4). That is, the annular rotator 60 guides the legs 36 and thereby turns the plunger 22 in the first direction 70, e.g., clockwise, about the central longitudinal axis 16 as the plunger 22 is initially depressed. Therefore, the annular rotator 60 converts the longitudinal travel of the plunger 22 into rotational motion, and positions the plunger 22 in a desired rotational position, i.e., the latched position 58, so that each leg 36 vertically aligns with each retention notch 48.

As such, as described by comparing FIGS. 4 and 5, after the operator releases the initial downward pressure on the plunger 22, e.g., after the operator senses that the door (not shown) or surface is properly mated or closed to the complementary component (not shown) so that the storage compartment (not shown) is covered, the plunger 22 may pop up slightly within the cavity 14 and yet be retained in the latched position 58 since each leg 36 abuts a respective one of the plurality of retention notches 48.

Referring now to FIGS. 4-7, the annular latch 62 is transitionable between an unlocked state 72 (FIG. 4) in which the annular latch 62 is positioned about the central longitudinal axis 16 such that the plunger 22 is transitionable between the open position 32 (FIG. 2) and the closed position 34 (FIG. 4), and a locked state 74 (FIG. 5) in which the annular latch 62 is positioned about the central longitudinal axis 16 such that the plunger 22 is not transitionable between the open position 32 and the closed position 34. The lockable latching device 10 may also include another resilient member (not shown), which may bias the annular latch 62 to the locked state 74 as a default or initial state.

Figure 8:
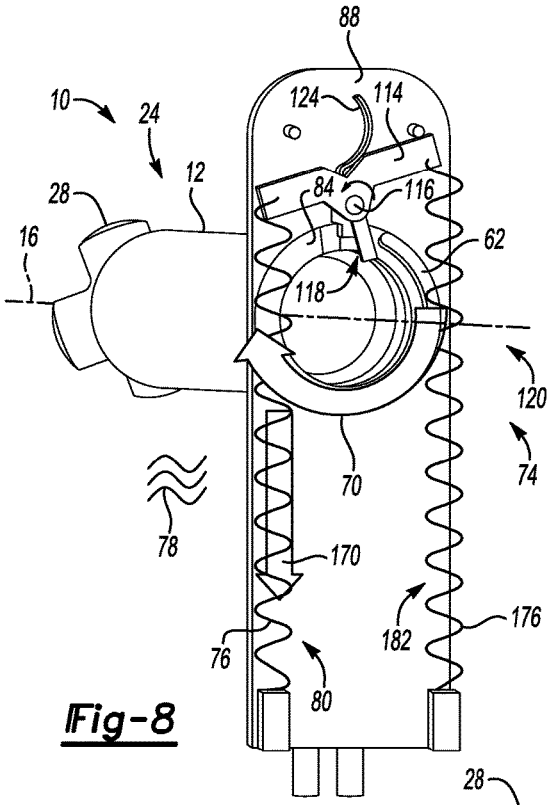
FIG. 8 is a schematic illustration of a bottom, perspective view of the lockable latching device of FIG. 1, wherein the annular latch has the locked state.
Figure 9:
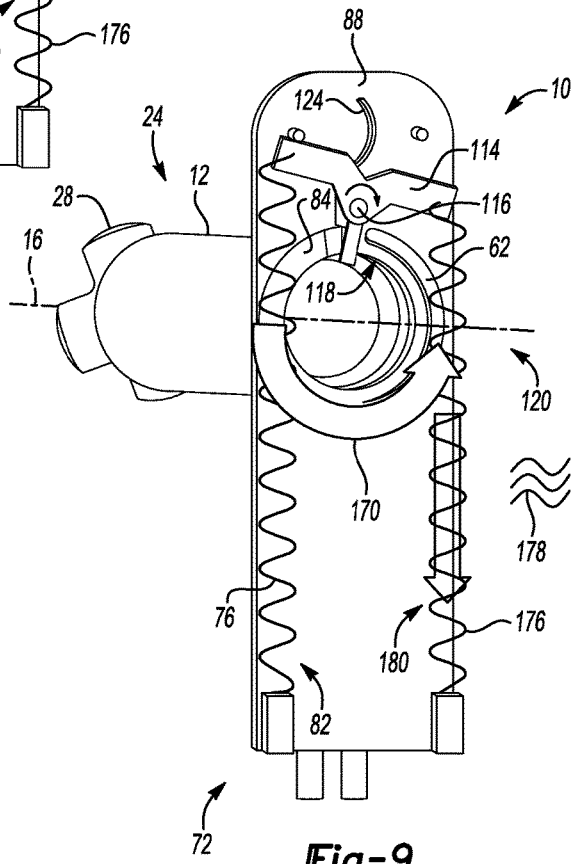
FIG. 9 is a schematic illustration of a bottom, perspective view of the lockable latching device of FIG. 8, wherein the annular latch has the unlocked state.

Further, as best shown in FIGS. 8 and 9, the lockable latching device 10 also includes a first element 76 operably connected to the annular latch 62 and formed from a first shape memory alloy. The first shape memory alloy is transitionable between a first austenite crystallographic phase and a first martensite crystallographic phase in response to a first activation signal 78 (FIG. 8), e.g., a thermal activation signal or heat, to thereby transition the annular latch 62 from the unlocked state 72 (FIG. 9) to a locked state 74 (FIG. 8).

The lockable latching device 10 also includes a second element 176 operably connected to the annular latch 62 and formed from a second shape memory alloy. The second shape memory alloy is transitionable between a second austenite crystallographic phase and a second martensite crystallographic phase in response to a second activation signal 178 (FIG. 9), e.g., a thermal activation signal or heat, to thereby transition the annular latch 62 from the locked state 74 (FIG. 8) to the unlocked state 72 (FIG. 9).

As shown in FIGS. 8 and 9, the lockable latching device 10 may further include a lever 114 attached to the first element 76 and the second element 176 and pivotable about a pivot axis 116 that is substantially parallel to the central longitudinal axis 16. That is, the lever 114 may tilt about the pivot axis 116 according to whether the first element 76 or the second element 176 exerts a greater force on the lever 114. The lever 114 may be biased or balanced by, for example, a leaf spring 124 (FIGS. 8 and 9).

The first shape memory alloy and the second shape memory alloy are each transitionable in response to the respective first and second activation signals 78, 178 between a first temperature-dependent state and a second temperature-dependent state. In particular, the first element 76 and the second element 176 may each be configured as a resilient member, i.e., a first resilient member and a second resilient member, respectively, and may be attached to the annular latch 62. Therefore, as set forth in more detail below, the first element 76 and the second element 176 may actuate the annular latch 62 by transitioning between the first temperature-dependent state and the second temperature-dependent state such that the annular latch 62 rotates about the central longitudinal axis 16 within the cavity 14.

In particular, the first element 76 may have a first powered state 80 (FIG. 8) in which the first activation signal 78 is applied to the first shape memory alloy, and a first non-powered state 82 (FIG. 9) in which the first activation signal 78 is not applied to the first shape memory alloy. The first powered state 80 may correspond to the locked state 74 of the annular latch 62.

Likewise, the second element 176 may have a second powered state 180 (FIG. 9) in which the second activation signal 178 is applied to the second shape memory alloy, and a second non-powered state 182 (FIG. 8) in which the second activation signal 178 is not applied to the second shape memory alloy. The second powered state 180 may correspond to the unlocked state 72 of the annular latch 62.

Therefore, the first element 76 may have the first powered state 80 and the second element 176 may have the second non-powered state 182 when the annular latch 62 is disposed in the locked state 74. Conversely, the second element 176 may have the second powered state 180 and the first element 76 may have the first non-powered state 82 when the annular latch 62 is disposed in the unlocked state 72.

As used herein, the terminology "shape memory alloy" refers to alloys that exhibit a shape memory effect and have the capability to quickly change properties in terms of stiffness, spring rate, and/or form stability. That is, the shape memory alloy may undergo a solid state crystallographic phase change via molecular or crystalline rearrangement to shift between the martensite crystallographic phase, i.e., "martensite", and the austenite crystallographic phase, i.e., "austenite". Stated differently, the shape memory alloy may undergo a displacive transformation rather than a diffusional transformation to shift between martensite and austenite. A displacive transformation is defined as a structural change that occurs by the coordinated movement of atoms or groups of atoms relative to neighboring atoms or groups of atoms. In general, the martensite phase refers to the comparatively lower-temperature phase and is often more deformable than the comparatively higher-temperature austenite phase.

The temperature at which the shape memory alloy begins to change from the austenite crystallographic phase to the martensite crystallographic phase is known as the martensite start temperature, $M_s$. The temperature at which the shape memory alloy completes the change from the austenite crystallographic phase to the martensite crystallographic phase is known as the martensite finish temperature, $M_f$. Similarly, as the shape memory alloy is heated, the temperature at which the shape memory alloy begins to change from the martensite crystallographic phase to the austenite crystallographic phase is known as the austenite start temperature, $A_s$. The temperature at which the shape memory alloy completes the change from the martensite crystallographic phase to the austenite crystallographic phase is known as the austenite finish temperature, $A_f$.

The shape memory alloy may have any suitable form, i.e., shape. For example, the first element 76 and the second element 176 may each be configured as a shape-changing element such as a wire, spring (FIGS. 8 and 9), tape, band, continuous loop, and combinations thereof. Further, the shape memory alloy may have any suitable composition, and the first shape memory alloy may be the same as or different from the second shape memory alloy. In particular, the shape memory alloy may include in combination an element selected from the group of cobalt, nickel, titanium, indium, manganese, iron, palladium, zinc, copper, silver, gold, cadmium, tin, silicon, platinum, and gallium. For example, suitable shape memory alloys may include nickel-titanium based alloys, nickel-aluminum based alloys, nickel-gallium based alloys, indium-titanium based alloys, indium-cadmium based alloys, nickel-cobalt-aluminum based alloys, nickel-manganese-gallium based alloys, copper based alloys (e.g., copper-zinc alloys, copper-aluminum alloys, copper-gold alloys, and copper-tin alloys), gold-cadmium based alloys, silver-cadmium based alloys, manganese-copper based alloys, iron-platinum based alloys, iron-palladium based alloys, and combinations of one or more of each of these combinations. The shape memory alloy can be binary, ternary, or any higher order so long as the shape memory alloy exhibits a shape memory effect, e.g., a change in shape orientation, damping capacity, and the like. Generally, the first and second shape memory alloys may be selected according to desired operating temperatures of the lockable latching device 10. In one specific example, the first and/or second shape memory alloys may include nickel and titanium.

Therefore, the first element 76 formed from the first shape memory alloy and the second element 176 formed from the second shape memory element may be characterized by a cold state, i.e., when a temperature of the shape memory alloy is below the martensite finish temperature, $M_f$, of the shape memory alloy. Likewise, the first element 76 formed from the first shape memory alloy and the second element 176 formed from the second shape memory alloy may also be characterized by a hot state, i.e., when the temperature of the shape memory alloy is above the austenite finish temperature, $A_f$, of the first and second shape memory alloys. In addition, although not shown, the lockable latching device 10 may include a plurality of first elements 76 formed from the first shape memory alloy and/or a plurality of second shape memory alloy elements 176 formed from the second shape memory alloy.

Referring again to FIG. 8, the first element 76 may contract in length in response to the first activation signal 78 to rotate the annular latch 62 in the first direction 70, e.g., clockwise about the central longitudinal axis 16 when viewed from position 120. That is, the first element 76 may pull on the lever 114, the lever 114 may pivot about the pivot axis 116, and the lever 114 may nudge the annular latch 62 so that the annular latch 62 rotates about the central longitudinal axis 16. For example, a portion of the lever 114 may rest within a cutout 118 defined by an annular base 84 of the annular latch 62, and the pivoting lever 114 may induce rotation of the annular latch 62 when the first shape memory alloy contracts in length.

Similarly, referring to FIG. 9, the second element 176 may contract in length in response to the second activation signal 178 to rotate the annular latch 62 in a second direction 170, e.g., counterclockwise about the central longitudinal axis 16 when viewed from position 120, that is opposite the first direction 70. That is, the second element 176 may pull on the lever 114, the lever 114 may pivot about the pivot axis 116, and the lever 114 may nudge the annular latch 62 so that the annular latch 62 rotates about the central longitudinal axis 16. For example, the portion of the lever 114 disposed within the cutout 118 may induce rotation of the annular latch 62 when the second shape memory alloy contracts in length. It is to be appreciated that the annular latch 62 may only be rotatable about the central longitudinal axis 16 in the second direction 170 when the annular latch 62 is disposed in the unlocked state 72, i.e., when the second activation signal 178 is applied to the second element 176.

Therefore, the leaf spring 124 may hold the annular latch 62 in position when the annular latch 62 has either of the unlocked state 72 or the locked state 74. That is, the first element 76 and the second element 176 may alternately contract upon exposure to the respective first and second activation signals 78, 178 to thereby reposition the lever 114. However, it is to be appreciated that, once repositioned, the leaf spring 124 may hold the lever 114 in place so that no continued first and second activation signals 78, 178 are required. That is, the first and second activation signals 78, 178 may be only momentary, and may not be continuously required to hold the annular latch 62 in position.

Referring again to FIGS. 6 and 7, the annular latch 62 may include a plurality of sloped protrusions 86 extending from the annular base 84 toward the distal end 20, wherein each of the sloped protrusions 86 is spaced apart from one another about the central longitudinal axis 16. During operation, the vertex 42 of a respective one of the plurality of legs 36 may traverse along the respective one of the plurality of sloped protrusions 86 as the plunger 22 transitions from the closed position 34 (FIG. 6) to the open position 32 (FIG. 2) when the second element 176 has the second powered state 180.

That is, the annular latch 62 may be rotatable about the central longitudinal axis 16 in the second direction 170 (FIG. 7) when the second element 176 has the second powered state 180. For example, referring again to FIG. 6, after the operator has transitioned the plunger 22 to the closed position 34, the operator may wish to re-open the door (not shown) or surface of the closure (not shown). To do so, the operator may reapply downward pressure to the plunger 22, i.e., push the plunger 22 towards the annular rotator 60 again, while the second activation signal 178 (FIG. 9) is applied to the second element 176. For example, the second activation signal 178 may be applied to the second element 176 in response to the operator depressing a key fob. Alternatively, the second activation signal 178 may be applied to the second element 176 via a computer or controller device such as a printed circuit board (shown generally at 88 in FIGS. 8 and 9) so that the second element 176 transitions from the second non-powered state 182 (FIG. 8) to the second powered state 180 (FIG. 9).

When the second element 176 has the second powered state 180, the second element 176 may contract and tug on the lever 114. In response, the annular latch 62 may rotate in the second direction 170 (FIG. 7) within the stationary annular rotator 60. Therefore, as the vertex 42 contacts a respective one of the plurality of sloped protrusions 86, the sloped protrusion 86 may guide the vertex 42 in the downward direction 130, rotate the plunger 22 in the first direction 70, and thereby position the plunger 22 such that each of the plurality of legs 36 may eventually travel within a respective one of the plurality of release channels 54 as the plunger 22 rebounds in the upward direction 30 along the central longitudinal axis 16 when the operator releases downward pressure from the plunger 22.

Figure 7:
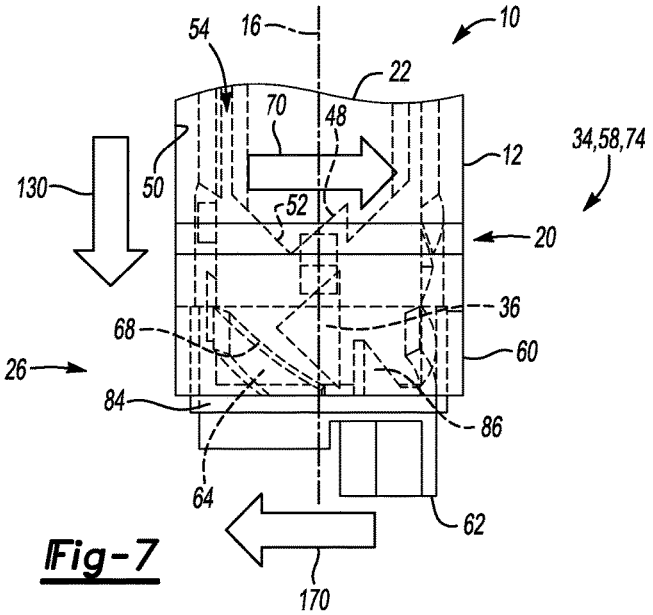
FIG. 7 is a schematic illustration of a partial side view of the lockable latching device of FIG. 6.

For example, as described with reference to FIGS. 5-7, in one non-limiting embodiment, when the second element 176 is disposed in the second powered state 180, i.e., when the second activation signal 178 is applied to the second shape memory alloy, and the plunger 22 is concurrently pushed downward along the central longitudinal axis 16 so as to unseat from the plurality of retention notches 48, the plurality of legs 36 may be positioned to travel within the respective ones of the plurality of release channels 54. That is, since the second element 176 has the second powered state 180, the annular latch 62 may move about the central longitudinal axis 16 and thereby reposition the plurality of sloped protrusions 86 along the central longitudinal axis 16. Conversely, if the first element 76 has the first powered state 80, the annular latch 62 may not rotate about the central longitudinal axis 16 and the plunger 22 may only re-seat against the plurality of retention notches 48 once the downward pressure is removed from the plunger 22.

Consequently, as described with reference to FIG. 4, as the plunger 22 continues to translate in the downward direction 130 (FIG. 5), the vertex 42 of the each of the plurality of legs 36 may contact a respective one of the plurality of sloped protrusions 86, which have been newly repositioned about the central longitudinal axis 16 as the pivoting lever 114 nudged the annular latch 62 in the second direction 170. The plurality of sloped protrusions 86 may therefore guide each vertex 42 in the downward direction 130 so that the plunger 22 consequently rotates about the central longitudinal axis 16 in the first direction 70. Therefore, since each leg 36 is no longer aligned with the respective one of the plurality of retention notches 48, when the downward pressure is again released from the plunger 22, the plunger 22 may pop up within the cavity 14 and each of the plurality of legs 36 may travel within a respective one of the plurality of release channels 54. Therefore, the plunger 22 may travel in the upward direction 30 so that the second end 26 no longer protrudes from the cavity 14 and the plunger 22 is disposed in the open position 32 (FIG. 2) to thereby open, e.g., unlatch and unlock, the door (not shown) or surface of the closure (not shown) from the complementary component (not shown).

Conversely, referring again to FIGS. 5-7, the plunger 22 may not be rotatable about the central longitudinal axis 16 in the second direction 170 when the first element 76 has the first powered state 80. Instead, as shown in FIG. 5, the annular latch 62 may be positioned apart from the leg 36 about the central longitudinal axis 16 when the first element 76 has the first powered state 80. Therefore, the closure (not shown) may remain locked such that the door (not shown) or surface is mated to the complementary component. That is, when the first element 76 has the first powered state 80, i.e., when the first activation signal 78 is applied to the first element 76, the annular latch 62 may not be triggered to reposition the plurality of sloped protrusions 86. Such a condition may be useful when it is desired that the closure remain locked while also allowing an operator to attempt to depress the plunger 22. That is, the plunger 22 may still be translatable away from the distal end 20 along the central longitudinal axis 16 when the plunger 22 is disposed in the closed position 34 and the first element 76 has the first powered state 80. However, as the operator again removes the downward pressure from the plunger 22, the plunger 22 may only re-translate along the central longitudinal axis 16 to again re-seat each leg 36 against a respective one of the plurality of retention notches 48. As such, the plunger 22 and door (not shown) or surface may remain in the closed position 34. That is, the door may be both latched and locked so that any attempt to unlatch the door is unsuccessful. Further, regardless of whether the first element 76 has the first powered state 80 or the first non-powered state 82, the plunger 22 may nonetheless be translatable in the downward direction 130 along the central longitudinal axis 16. Therefore, regardless of whether the first activation signal 78 is applied or not applied to the first element 76, an operator may always close or latch the door (not shown) or surface against the complementary component (not shown) of the closure (not shown).

Referring again to FIG. 1, the lockable latching device 10 may also include an actuator housing 92. The actuator housing 92 may protect an actuator portion of the lockable latching device 10, e.g., the annular latch 62, the first element 76, and the second element 176, from contaminants. The actuator housing 92 may have a first portion 94 attachable to the body 12 and defining a first bore 96 therein. The actuator housing 92 may also have a second portion 98 substantially perpendicular to the first portion 94 and defining a second bore 100 therein. Therefore, the first bore 96 and the second bore 100 may be connected to form an L-shaped channel 102. The first element 76 (FIGS. 8 and 9) may be configured as a first resilient member and may be disposed within the second bore 100 along the second portion 98, and the second element 176 (FIGS. 8 and 9) may be configured as a second resilient member and may also be disposed within the second bore 100 along the second portion 98. The lockable latching device 10 may also include a cover 122 matable to the actuator housing 92 and configured for protecting the first element 76 and the second element 176 from contaminants.

With continued reference to FIG. 1, the body 12 may also have an exterior surface 104 and may include a plurality of tabs 106 extending from the exterior surface 104. In addition, the actuator housing 92 may include a plurality of arms 108 each attachable to a respective one of the plurality of tabs 106 to thereby attach the body 12 to the actuator housing 92. As such, the annular rotator 60, the annular latch 62, and the plunger 22 may be disposed within the first bore 96, and the first element 76 and the second element 176 may be disposed within the second bore 100 along the second portion 98.

Therefore, in operation and described generally, when the annular latch 62 has the unlocked state 72, the operator may first push against the plunger 22 so that the plunger 22 travels in the downward direction 130 within the cavity 14 along the central longitudinal axis 16. As the legs 36 of the plunger 22 contact the plurality of ramps 64 of the annular rotator 60, the plurality of ramps 64 may guide the legs 36 downward and in the first direction 70 to thereby rotate the plunger 22 about the central longitudinal axis 16 until each leg 36 is longitudinally aligned to abut and seat against a respective one of the plurality of retention notches 48. As the operator removes the applied downward pressure from the plunger 22, the plunger 22 may rebound in the upward direction 30 along the central longitudinal axis 16 until each leg 36 contacts the respective one of the plurality of retention notches 48 and thereby retains the plunger 22 in the latched position 58 so that the door (not shown) or surface may be closed or latched to the complementary component (not shown) of the closure.

Under one option, the operator may next attempt to open or unlatch the door (not shown) or surface from the complementary component (not shown) when the first element 76 has the first powered state 80, i.e., when the first activation signal 78 is applied to the first element 76. For this option, the operator may again push the plunger 22 in the downward direction 130 along the central longitudinal axis 16. However, since the first activation signal 78 is applied to the first element 76, the second element 176 may not contract, may not pivot the lever 114, and may not rotate the annular latch 62. As such, the annular latch 62 may not be in the unlocked state 72 and the plurality of sloped protrusions 86 may not assist in rotating the plunger 22 again so that each leg 36 cannot travel toward and within the plurality of release channels 54. Rather, the annular latch 62 may not rotate, and the plunger 22 may again rebound in the upward direction 30 when the applied pressure is removed from the plunger 22 so that each leg 36 is again retained against a respective one of the plurality of retention notches 48. Consequently, the plunger 22 may not successfully open or unlatch the door (not shown) or surface.

It is noted that even if the operator once again depresses the plunger 22, e.g., perhaps in an attempt to open or unlatch the door (not shown) or surface from the complementary component (not shown), the plunger 22 will remain in the closed position 34 (FIG. 5) when the annular latch 62 is disposed in the locked state 74. That is, although the plunger 22 may again depress towards the annular rotator 60 in response to the secondary or additional downward pressure applied to the plunger 22 by the operator, the plunger 22 may not further rotate about the central longitudinal axis 16 when the annular latch 62 is disposed in the locked state 74. Rather, since the annular rotator 60 is stationary with respect to the body 12 and the plurality of ramps 64 are only aligned to guide the vertex 42 of each leg 36 into a position such that each leg 36 is positioned to abut the respective one of the plurality of retention notches 48, the plunger 22 is yet again retained against the plurality of retention notches 48 when the plunger 22 is again released in the upward direction 30 (FIG. 5). Therefore, the operator may depress and release the plunger 22 multiple times in succession after the initial push against the plunger 22, and yet the plunger 22 may not rotate to the unlatched position 56 until the annular latch 62 is actuated to the unlocked state 72.

Stated differently, in order to transition the plunger 22 from the closed position 34 to the open position 32 and thereby re-open the door (not shown) or surface mated to the complementary component (not shown) of the closure (not shown), two conditions must be satisfied: 1) downward pressure must be applied to the plunger 22 and 2) the annular latch 62 must be actuated so that the plunger 22 may rotate about the central longitudinal axis 16.

Under an alternative option, the operator may next attempt to open or unlatch the door (not shown) or surface from the complementary component (not shown) when the second element 176 has the second powered state 180, i.e., when the second activation signal 178 is applied to the second element 176. For this option, the operator may again push the plunger 22 in the downward direction 130 along the central longitudinal axis 16. However, since the second activation signal 178 is applied to the second element 176, the second element 176 may contract, pivot the lever 114, and may accordingly rotate the annular latch 62 in the second direction 170. As such, the annular latch 62 may transition to the unlocked state 72 and the plurality of sloped protrusions 86 may assist in rotating the plunger 22 so that each leg 36 may travel down a respective sloped protrusion 86 towards a respective release channel 54, and eventually travel upwards within the respective release channel 54. That is, the annular latch 62 may rotate in the second direction 170 and the plunger 22 may again rebound in the upward direction 30 when the applied pressure is removed from the plunger 22 so that each leg 36 is not retained against a respective one of the plurality of retention notches 48. Consequently, the plunger 22 may successfully open or unlatch the door (not shown) or surface.

It is to be appreciated that the first element 76 and the second element 176 may be arranged in any configuration. For example, the first element 76 may be configured to unlock the door if the plunger 22 is depressed, the first element 76 is not exposed to the first activation signal 78, and the annular latch 62 has the unlocked state 72. Alternatively, the second element 176 may be configured to unlock the door if the plunger 22 is depressed, the second element 176 is not exposed to the second activation signal 178, and the annular latch 62 has the unlocked state 72. In another configuration, the first element 76 may be configured to unlock the door if the plunger 22 is depressed while the first element 76 is exposed to the first activation signal 78 when the annular latch 62 has the locked state 74. Alternatively, the second element 176 may be configured to unlock the door if the plunger 22 is depressed while the second element 176 is exposed to the second activation signal 178 when the annular latch 62 has the locked state 74.

As such, the lockable latching device 10 may be configured as a push-push latch that is both latchable and lockable. That is, a latching function of the lockable latching device 10 may be controlled by the plunger 22, the annular rotator 60, and the body 12, while a locking function of the lockable latching device 10 may be separately controlled by the annular latch 62, the first element 76, and the second element 176. That is, the latching function may be de-coupled from the locking function.

While the best modes for carrying out the disclosure have been described in detail, those familiar with the art to which this disclosure relates will recognize various alternative designs and embodiments for practicing the disclosure within the scope of the appended claims.

The invention claimed is:

1. A lockable latching device comprising:

a body defining a cavity therein and having a central longitudinal axis;

a plunger disposed within the cavity and having a first end and a second end spaced apart from the first end, wherein the plunger is translatable with respect to the body along the central longitudinal axis between:

an open position in which the second end is disposed within the cavity; and a closed position in which the second end protrudes from the cavity;

wherein the plunger includes a plurality of legs extending from the second end and each spaced apart from one another about the central longitudinal axis;

wherein each of the plurality of legs includes:

a first edge that is substantially parallel to the central longitudinal axis;

a second edge intersecting the first edge at a vertex that is spaced apart from the second end, wherein the first edge and the second edge define an acute angle therebetween; and a third edge connecting the first edge and the second edge;

wherein the body has an internal surface facing the plunger and includes a plurality of ribs extending along the internal surface, wherein adjacent ones of the plurality of ribs define a retention notch therebetween, and further wherein one of the plurality of legs is matable with the retention notch as the plunger translates from the open position to the closed position;

an annular rotator disposed along the central longitudinal axis and configured for rotating the plunger about the central longitudinal axis;

an annular latch abutting the annular rotator and transitionable between:

an unlocked state in which the annular latch is positioned about the central longitudinal axis such that the plunger is transitionable between the open position and the closed position; and a locked state in which the annular latch is positioned about the central longitudinal axis such that the plunger is not transitionable between the open position and the closed position;

a first element operably connected to the annular latch and formed from a first shape memory alloy that is transitionable between a first austenite crystallographic phase and a first martensite crystallographic phase in response to a first activation signal to thereby transition the annular latch from the unlocked state to the locked state; and a second element operably connected to the annular latch and formed from a second shape memory alloy that is transitionable between a second austenite crystallographic phase and a second martensite crystallographic phase in response to a second activation signal to thereby transition the annular latch from the locked state to the unlocked state;

wherein the body has a proximal end and a distal end spaced apart from the proximal end along the central longitudinal axis, and further wherein the plunger is rotatable about the central longitudinal axis between:

an unlatched position in which one of the plurality of legs is positioned about the central longitudinal axis so that the one of the plurality of legs is not abuttable with the retention notch as the plunger translates towards the distal end; and a latched position in which the one of the plurality of legs is positioned about the central longitudinal axis so that the one of the plurality of legs is abuttable with the retention notch as the plunger translates towards the proximal end.

2. The lockable latching device of claim 1, wherein the internal surface defines a plurality of release channels therein, and wherein adjacent ones of the plurality of release channels are spaced apart from one another by the plurality of ribs.

3. The lockable latching device of claim 2, wherein a respective one of the plurality of legs abuts the retention notch when the plunger is disposed in the latched position, and wherein each of the plurality of legs is translatable within a respective one of the plurality of release channels when the plunger is disposed in the open position.

4. The lockable latching device of claim 3, wherein the annular rotator is disposed between the body and the annular latch about the central longitudinal axis.

5. The lockable latching device of claim 4, wherein the annular rotator includes a plurality of ramps each configured for guiding the vertex of a respective one of the plurality of legs towards the annular latch as the plunger rotates between the unlatched position and the latched position.

6. The lockable latching device of claim 5, wherein the vertex translates along a respective one of the plurality of ramps to rotate the plunger in a first direction and translate the plunger from the unlatched position to the latched position.

7. The lockable latching device of claim 6, further including a lever attached to the first element and the second element and pivotable about a pivot axis that is substantially parallel to the central longitudinal axis.

8. The lockable latching device of claim 7, wherein the first element contracts in length in response to the first activation signal to rotate the annular latch in the first direction.

9. The lockable latching device of claim 7, wherein the second element contracts in length in response to the second activation signal to rotate the annular latch in a second direction that is opposite the first direction.

10. The lockable latching device of claim 9, wherein the first element has a first powered state in which the first activation signal is applied to the first shape memory alloy and a first non-powered state in which the first activation signal is not applied to the first shape memory alloy; and wherein the second element has a second powered state in which the second activation signal is applied to the second shape memory alloy and a second non-powered state in which the second activation signal is not applied to the second shape memory alloy.

11. The lockable latching device of claim 10, wherein the plunger is not rotatable about the central longitudinal axis in the first direction when the first element has the first powered state.

12. A lockable latching device comprising:

a body defining a cavity therein and having a central longitudinal axis;

a plunger disposed within the cavity and having a first end and a second end spaced apart from the first end, wherein the plunger is translatable with respect to the body along the central longitudinal axis between:

an open position in which the second end is disposed within the cavity; and a closed position in which the second end protrudes from the cavity;

wherein the plunger includes a plurality of legs extending from the second end and each spaced apart from one another about the central longitudinal axis;

wherein each of the plurality of legs includes:

a first edge that is substantially parallel to the central longitudinal axis;

a second edge intersecting the first edge at a vertex that is spaced apart from the second end, wherein the first edge and the second edge define an acute angle therebetween; and a third edge connecting the first edge and the second edge;

wherein the body has an internal surface facing the plunger and includes a plurality of ribs extending along the internal surface, wherein adjacent ones of the plurality of ribs define a retention notch therebetween, and further wherein one of the plurality of legs is matable with the retention notch as the plunger translates from the open position to the closed position;

an annular rotator disposed along the central longitudinal axis and configured for rotating the plunger about the central longitudinal axis;

an annular latch abutting the annular rotator and transitionable between:

an unlocked state in which the annular latch is positioned about the central longitudinal axis such that the plunger is transitionable between the open position and the closed position; and a locked state in which the annular latch is positioned about the central longitudinal axis such that the plunger is not transitionable between the open position and the closed position;

wherein the annular latch includes a plurality of sloped protrusions each spaced apart from one another about the central longitudinal axis;

a first element operably connected to the annular latch and formed from a first shape memory alloy that is transitionable between a first austenite crystallographic phase and a first martensite crystallographic phase in response to a first activation signal to thereby transition the annular latch from the unlocked state to the locked state; and a second element operably connected to the annular latch and formed from a second shape memory alloy that is transitionable between a second austenite crystallographic phase and a second martensite crystallographic phase in response to a second activation signal to thereby transition the annular latch from the locked state to the unlocked state;

wherein the body has a proximal end and a distal end spaced apart from the proximal end along the central longitudinal axis, and further wherein the plunger is rotatable about the central longitudinal axis between:

an unlatched position in which one of the plurality of legs is positioned about the central longitudinal axis so that the one of the plurality of legs is not abuttable with the retention notch as the plunger translates towards the distal end; and a latched position in which the one of the plurality of legs is positioned about the central longitudinal axis so that the one of the plurality of legs is abuttable with the retention notch as the plunger translates towards the proximal end.

13. The lockable latching device of claim 12, wherein the vertex of a respective one of the plurality of legs traverses along a respective one of the plurality of sloped protrusions as the plunger transitions from the closed position to the open position when the second element has the second powered state.

14. A lockable latching device comprising:

a body defining a cavity therein and having a central longitudinal axis;

a plunger disposed within the cavity and having a first end and a second end spaced apart from the first end, wherein the plunger is translatable with respect to the body along the central longitudinal axis between:

an open position in which the second end is disposed within the cavity; and a closed position in which the second end protrudes from the cavity;

an annular rotator disposed along the central longitudinal axis and configured for rotating the plunger about the central longitudinal axis;

an annular latch abutting the annular rotator and transitionable between:

an unlocked state in which the annular latch is positioned about the central longitudinal axis such that the plunger is transitionable between the open position and the closed position; and a locked state in which the annular latch is positioned about the central longitudinal axis such that the plunger is not transitionable between the open position and the closed position;

a first element operably connected to the annular latch and formed from a first shape memory alloy that is transitionable between a first austenite crystallographic phase and a first martensite crystallographic phase in response to a first activation signal to thereby transition the annular latch from the unlocked state to the locked state;

a second element operably connected to the annular latch and formed from a second shape memory alloy that is transitionable between a second austenite crystallographic phase and a second martensite crystallographic phase in response to a second activation signal to thereby transition the annular latch from the locked state to the unlocked state; and an actuator housing having:

a first portion attachable to the body and defining a first bore therein; and a second portion substantially perpendicular to the first portion and defining a second bore therein, wherein the first bore and the second bore are connected to define an L-shaped channel;

wherein the annular rotator, the annular latch, and the plunger are disposed within the first bore.

15. The lockable latching device of claim 14, wherein the first element is configured as a first resilient member and is disposed within the second bore along the second portion, and wherein the second element is configured as a second resilient member and is disposed within the second bore along the second portion.

* * * * *